US009855194B1

(12) United States Patent
Walter, Jr.

(10) Patent No.: US 9,855,194 B1
(45) Date of Patent: Jan. 2, 2018

(54) SOLID FOOD DISPENSER AND KIT

(71) Applicant: Michael C. Walter, Jr., Buffalo, WY (US)

(72) Inventor: Michael C. Walter, Jr., Buffalo, WY (US)

( * ) Notice: Subject to any disclaimer, the term of this patent is extended or adjusted under 35 U.S.C. 154(b) by 168 days.

(21) Appl. No.: 14/799,554

(22) Filed: Jul. 14, 2015

Related U.S. Application Data

(60) Provisional application No. 62/024,120, filed on Jul. 14, 2014.

(51) Int. Cl.
*A61J 9/04* (2006.01)
*A61J 9/00* (2006.01)
*A61J 11/00* (2006.01)

(52) U.S. Cl.
CPC ..... *A61J 9/005* (2013.01); *A61J 11/0095* (2013.01)

(58) Field of Classification Search
CPC ..... A61J 9/04; A61J 9/005
USPC ..... 215/11.3, 11.4, 11.1; 383/80; 206/218
See application file for complete search history.

(56) References Cited

U.S. PATENT DOCUMENTS 2,954,030 A 9/1960 Jozwiak
3,206,054 A 9/1965 Militello
3,549,036 A 12/1970 Ritsi
4,657,151 A 4/1987 Cabernoch
5,013,321 A 5/1991 MacVane
5,035,340 A * 7/1991 Timmons ..... A61J 11/002 215/11.1
5,083,678 A 1/1992 Waring
5,154,318 A 12/1992 Lampard
5,620,462 A 4/1997 Valenti
5,662,684 A 9/1997 Caso
5,843,030 A 12/1998 Van Der Merwe
6,003,698 A * 12/1999 Morano ..... A61J 11/001 215/11.1
6,547,808 B2 4/2003 Tuckey et al.
6,923,332 B1 8/2005 Thomas
7,032,764 B2 * 4/2006 Viggiano ..... A61J 9/00 215/11.1
8,029,538 B2 10/2011 Burroughs et al.
9,060,918 B1 * 6/2015 Tomassini ..... A61J 9/005
2006/0151420 A1 * 7/2006 Espenschied ..... A61J 11/04 215/276
2007/0131637 A1 * 6/2007 Tamura ..... A61J 11/004 215/11.1

(Continued)

FOREIGN PATENT DOCUMENTS

GB 2181062 A * 4/1987 ..... A61J 9/005

*Primary Examiner* — Sue A Weaver
(74) *Attorney, Agent, or Firm* — Jason P. Webb; Pearson Butler

(57) ABSTRACT

A food dispenser configured to dispense solid food for immediate consumption. The food dispenser includes a nipple. The nipple includes a first end and a second end. The nipple includes a bite valve disposed on the first end. The food dispenser includes a shield coupled to the nipple, at the second end of the nipple. The shield is a flat annular disc that is not cupped. The nipple and the shield is a single integral unit. The food dispenser includes a food pouch having flexible side-walls coupled to the shield and in fluid communication with the bite valve. The food dispenser includes an adapter coupled between the shield and the food pouch mating incompatible attachment structures of each.

20 Claims, 8 Drawing Sheets

(56) References Cited

U.S. PATENT DOCUMENTS

| | | | | |
|---|---|---|---|---|
| 2007/0138121 | A1* | 6/2007 | Stribling | A47G 19/2272 215/11.4 |
| 2009/0120894 | A1* | 5/2009 | Kario | A47G 19/2272 215/11.1 |
| 2010/0215294 | A1* | 8/2010 | Berman | A61J 11/0095 383/202 |
| 2011/0046671 | A1 | 2/2011 | Okoturo | |
| 2011/0284491 | A1* | 11/2011 | Bryan | A61J 9/04 215/11.4 |
| 2012/0035655 | A1 | 2/2012 | Trocki | |
| 2012/0097710 | A1* | 4/2012 | Ahmer | A61J 9/005 222/212 |
| 2013/0319965 | A1 | 12/2013 | Reynolds | |
| 2014/0296915 | A1* | 10/2014 | Finney | A61J 17/006 606/236 |

* cited by examiner

SOLID FOOD DISPENSER AND KIT

CROSS-REFERENCE TO RELATED APPLICATIONS

This invention claims priority, under 35 U.S.C. §120, to the U.S. Provisional Patent Application No. 62/024,120 to Michael C. Walter Jr. filed on Jul. 14, 2014 which is incorporated by reference herein.

BACKGROUND OF THE INVENTION

Field of the Invention

The present invention relates to food dispensers, specifically to a solid food dispenser and solid food dispenser kit.

Description of the Related Art

Baby food is any soft, easily consumed food, other than breastmilk or infant formula, that may be made specifically for infants roughly between the ages of about four months and about two years. The food comes in multiple varieties and tastes; it may be table food that the rest of the family is eating that has been mashed or otherwise broken down, or it may be purchased ready-made from producers.

Baby foods are either a soft, liquid paste or an easily chewed food since babies lack developed muscles and teeth to effectively chew. Babies typically move to consuming baby food once nursing or formula is not sufficient for the child's appetite. Babies do not need to have teeth to transition to eating solid foods. Teeth, however, normally do begin to show up at this age. Care should be taken with certain foods that pose a choking hazard, such as undercooked vegetables, grapes, or food that may contain bones. Babies begin eating liquid style baby food consisting of pureed vegetables and fruits, sometimes mixed with rice cereal and formula, or breastmilk. Then, as the baby is better able to chew, small, soft pieces or lumps may be included, which initiates the transition into eating solid food. Care should be taken, as babies with teeth have the ability to break off pieces of food but they do not possess the back molars to grind, so food can be carefully mashed or pre-chewed, or broken into manageable pieces for their baby. Around 6 months of age, babies may begin to feed themselves (picking up food pieces with hands, using the whole fist, or later the thumb and forefinger (like a pincer) with help from parents.

Generally, babies eat liquid food from a bottle or breast, while eating solid food either by spoon or by hand. Eating solid food by hand or with a spoon is somewhat difficult for babies and tends to be messy and time consuming for their caregivers.

Some improvements have been made in the field. Examples of references related to the present invention are described below in their own words, and the supporting teachings of each reference are incorporated by reference herein:

U.S. Pat. No. 8,029,538, issued to Burroughs et al., discloses an infant mouthpiece includes a U-shaped mouth mold for inserting into the mouth of the infant, wherein the mouth mold comprises a top, a bottom, a center, a distal end, a proximal end, and a plurality of ridges disposed along the top of the mouth mold. The infant mouthpiece further includes a female portion of a plug and a stopper, wherein the stopper comprises a proximal side, a distal side, and a center. The mouth mold, the stopper, and the female portion of the plug are connected such that the proximal end of the mouth mold is connected to the distal side of the stopper and the proximal side of the stopper is connected to the female portion of the plug.

U.S. Patent Application Publication No.: 2012/0035655, by Trocki, discloses a dual function suckling device. In the first configuration it operates as a small feeding bottle. In the second configuration it operates as a pacifier. It bridges the gap between regular size bottles and pacifiers. This device comprises: a bottle, a plug, and a nipple assembly having a mouth-guard and a cylindrical base equipped with a sealing ring. The cylinder base is configured to be either attached to the bottle, thereby allowing the device to operate as a feeder or stopped up by the plug, thereby allowing the device to operate as a pacifier. Variations of this design include adding a protective cap.

U.S. Patent Application Publication No.: 2013/0319965, by Reynolds, discloses a flavored infant device, in particular a flavored pacifier or nipple, which provides a long lasting, soothing alternative to traditional pacifiers and bottle nipples. The flavor infused pacifier or nipple provides a multiple use flavor delivery to an infant, without a substantial reduction in flavor.

The inventions heretofore known suffer from a number of disadvantages which include one or more of being messy, being difficult to use, being difficult to apply, being complicated, not integrating with existing products, not allowing for child mobility when eating solid foods, delaying a transition to solid foods, requiring too much supervision/time from parents while in operation, being uncomfortable, being usable only for a limited time because of changes in the babies face shape and/or size, being frustrating (for kids and/or parents), being awkward to use especially at different angles, being difficult to clean, and requiring utensils.

What is needed is a food dispenser and/or kit that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available food dispensers. Accordingly, the present invention has been developed to provide a food dispenser for solid food containers.

According to one embodiment of the invention, there is a food dispenser configured to dispense solid food for immediate consumption. The food dispenser may include a nipple. The nipple may have a first end and a second end, opposite the first end. The nipple may include a bite valve that may be disposed on the first end.

The food dispenser may include a shield that may be coupled to the nipple, at the second end of the nipple. The shield may be a flat annular disc that may not be cupped. The shield may include a protruding attachment member extending opposite the nipple. The nipple and the shield may be a single integral unit. The nipple and the shield may be co-molded together.

The food dispenser may include a food pouch that may have flexible side-walls that may be coupled to the shield and may be in fluid communication with the bite valve. The food pouch may contain solid food.

The food dispenser may include a threaded connector between the shield and the food pouch that may selectably connect the shield to the food pouch. The food dispenser may include an adapter that may be coupled between the shield and the food pouch that may mate incompatible attachment structures of each.

According to on embodiment of the invention, there is a food dispensing kit configured to dispense solid food for immediate consumption. The kit may include a nipple that may have a first end and a second end, the second end opposite the first end that may include a bite valve that may be disposed on the first end.

The kit may include a shield that may be coupled to the nipple, at the second end of the nipple. The shield may be a flat annular disc that may not be cupped. The shield may include a protruding attachment member that may be extending opposite the nipple. The nipple and the shield may be a single integral unit. The nipple and the shield may be co-molded together.

The kit may include a food pouch that may have flexible side-walls that may be in fluid communication with the bite valve. The food pouch may contain solid food. The kit may include a threaded connector between the shield and the food pouch that may selectably connect the shield to the food pouch. The kit may include an adapter coupled between the shield and the food pouch that may mate incompatible attachment structures of each.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
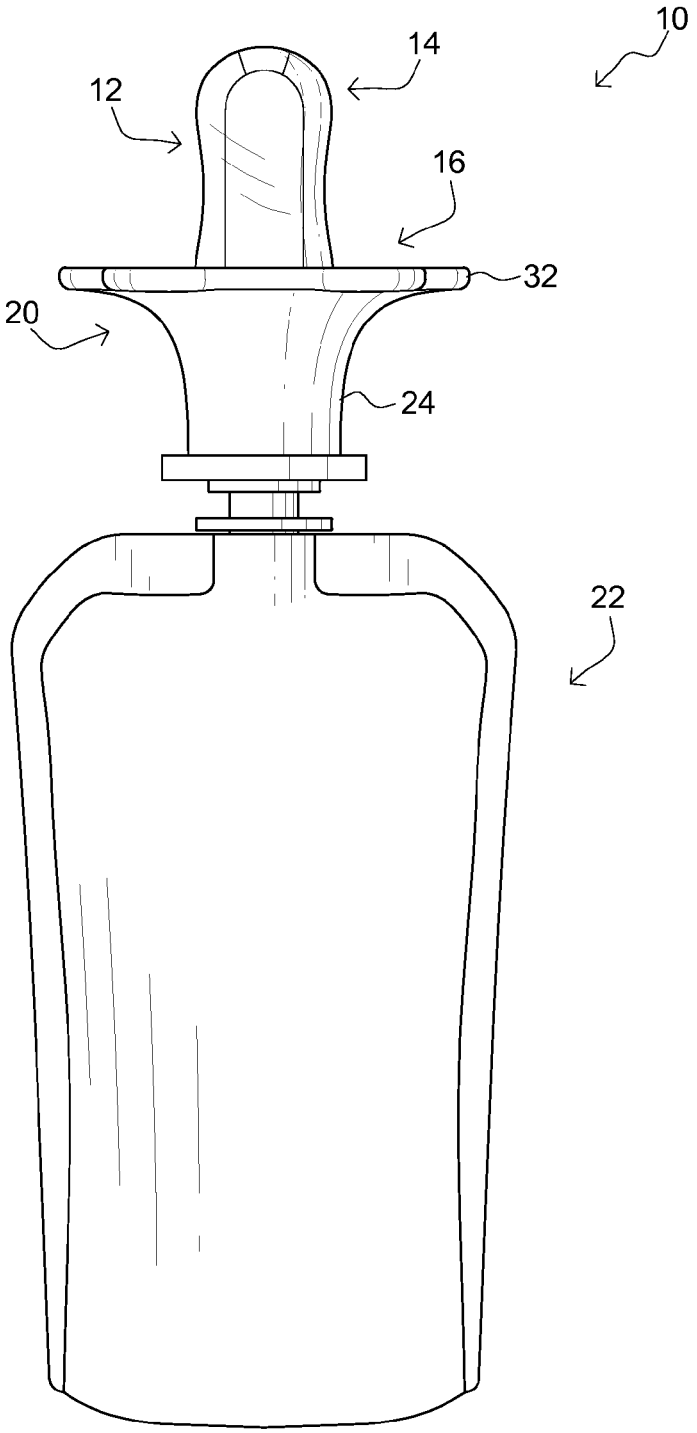
FIG. 1 is a side elevational view of a food dispenser, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a food dispenser, according to one embodiment of the invention. There is shown a food dispenser 10 including a nipple 12 coupled to a shield 20 that is coupled to a food pouch 22. The nipple includes a valve at the tip thereof formed by one or more slits that allows for the hole to be enlarged to let solid food pass therethrough, such a valve may be a bite valve wherein there is a single slit positioned and oriented through the tip of the nipple such that if the user bites on the nipple, especially against the direction of the slit, the slit opens and allows material to pass therethrough. Generally a bit valve will have weaker/thinner side walls (see FIG. 2) at the ends of the slit and/or opposing V-shaped or U-shaped variable thicknesses of side walls that facilitate in allowing the nipple to deform (e.g. hinging to allow for an effective shortening of the slit) in a manner that opens the bite valve when it is bit. Advantageously, a growing child may use the illustrated food dispenser to each solid food and to eat from food pouches on the market today that have solid food therein intended for consumption by adults without the mess and problems of eating by hand and/or by spoon before the child has the coordination needed to do so properly.

The illustrated food dispenser 10 is configured to dispense solid food for immediate consumption. The food dispenser 10 includes a nipple 12. The illustrated nipple 12 is a flexible nozzle that simulates a human nipple and/or that of a baby bottle or binky. The nipple 12 includes a first end 14 and a second end 16, opposite the first end 14. During operation, material passes from outside the nipple into the second end 16 thereof and then through an interior of the nipple and out the first end 14.

The food dispenser 10 includes a shield 20 coupled to the nipple 12, at the second end 16 of the nipple 12. The shield 20 includes a flat annular disc 32 that is not cupped and may be of a solid substantially rigid plastic material. The shield 20 includes a protruding attachment member 24 extending from the disc 32 opposite the nipple 12. The illustrated nipple 12 and shield 20 are a single integral unit that do not come apart. Such may be co-molded together or otherwise formed in a manner that they are not separable in contrast to how baby bottles tend to have separable nipples.

The food dispenser 10 includes a food pouch 22 having flexible side-walls, such as but not limited to being of a multi-layered fluid impermeable foil-plastic material configured to flexibly store fluid materials. The illustrated food pouch is coupled to the shield 20 and in fluid communication with the nipple 12. Such a coupling may be by operation of mating threads, snaps, clips, friction fittings, and the like and combinations thereof. The illustrated food pouch 22 contains solid food, such as but not limited to pureed (or otherwise liquefied or made easy to eat) fruits and/or vegetables (e.g. carrot, apple, squash, peas, bananas, strawberries, green beans), meats (e.g. beef, chicken, fish), and/or starches (e.g. potatoes, grain meals (e.g. rice, corn, wheat, quinoa, rye) with solid chunks of such therein. Accordingly, during operation, the liquefied portion serves to carry the solid chunks towards the nipple in a slurry of food materials where they may be consumed.

According to one embodiment of the invention, there is a solid food dispenser coupled to a solid food container. The illustrated solid food dispenser is a standalone dispenser that has been modified to couple to a commercially available solid food container (a flexible bag containing pureed fruits and vegetables) such that a aperture through the nipple of the dispenser is in slurry communication with an interior of the solid food container such that when the dispenser is manipulated (sucked) by the user, the solid food (slurry) found within the solid food container may travel through the backside of the dispenser into the nipple and out the aperture of the same, thus allowing the user to eat solid foods without requiring a spoon. The aperture of the nipple is larger than what is needed for liquid dispensing (e.g. bottles of milk or formula) and is not just a round aperture, but instead includes at least one or more slits therethrough so that it may be closed when not in use but may open to a large degree to allow for solid chunks to pass therethrough during use.

The illustrated solid food dispenser is a device for aiding a child or infant to eat while transitioning from a bottle to solid food. The solid food dispenser is coupled to a disposable solid-food container or pouch that couples to a nipple capable of delivering the solid food therethrough. The container or pouch easily couples to the solid food dispenser and nipple. The nipple includes a larger aperture than a bottle nipple and includes a mouth bracket (mouth shield) similar to that found on a standalone dispenser (aka pacifier, dummy, and soother). The larger aperture is split instead of just being a hole, so that it may be widen as needed, but may not be an open hole. Therefore, suction may be required to get material through the aperture. The solid food dispenser includes a nipple for dispensing the solid food therefrom. The solid food dispenser includes an attachment member for coupling the dispenser and nipple to the food container or pouch.

The illustrated food dispenser includes a nipple having an aperture therethrough suitable for dispensing solid foods therefrom. Such an aperture will be larger and may include structure not found in apertures configured for dispensing simple fluids (milk, water, solutions, etc.). Such an aperture may include one or more slits that may cross each other, thereby being sealed until suction is applied to the aperture, whereupon the slits separate and thereby a large aperture results, which may enlarge under force, thus permitting solid food of varying effective radii, varying cross-section areas, consistencies, etc. to be dispensed therethrough.

The illustrated mouth guard includes a rigid shield coupled to the nipple opposite the aperture of the nipple. The shield is oriented substantially orthogonal to the long axis of the nipple and prevents the nipple from entering too far into the mouth of the user when suction is applied to the nipple when placing the nipple in the mouth of the user. The shield is larger in cross-sectional area than the mouth of the intended user so that it will not enter the mouth of the user under operating conditions.

The illustrated shield is curved and includes a hole therethrough such that solid food may pass through the shield into the nipple. The mouth guard includes a cylindrical coupling device extending out a back side the mouth guard, the coupling device configured to mate with a similar coupling device found on the illustrated associated food pouch. The coupling device is a threaded cylinder that can freely rotate about a hub coupled to the shield.

The illustrated food pouch or container includes a multi-layered envelope of fluid impermeable material having an orifice with a coupling device disposed therearound. The coupling device is shaped and positioned to mate with the threaded cylinder of the mouth guard so as to form a fluid tight seal and thus create fluid communication between the interior of the food pouch and the interior of the nipple. The food pouch may include layers of plastics, papers, fibrous materials, and/or metal foils such that the food pouch is flexible and protects the contents during shipping, storage, sale and use. The food pouch will generally be sold filled with a solid food, such as but not limited to solid baby foods that are traditionally sold in miniature glass jars (e.g. Gerber baby food).

According to one embodiment of the invention, the solid food dispenser is configured to provide a means to combine a food dispenser with a food pouch. The solid food dispenser includes slit aperture in the dispenser's nipple. The solid food dispenser is easy to attach and detach from the food container or pouch. The solid food dispenser includes a mouth bracket disposed on the food dispenser with a nipple. The solid food dispenser provides a simple less mess design with easy to use and easy to apply capabilities to a food container or pouch. The solid food dispenser is designed to be used with existing food containers and pouches. The solid food dispenser provides mobility while eating solid food. The solid food dispenser allows for children to start eating solid food earlier.

According to one embodiment of the invention, there is a combination dispenser and food pouch. The pouch may be a box or flexible container. It may be that the food dispenser assembly and pouch are integral and not separable. It may be that there is no mouth bracket coupled to the dispenser. There may be one or more collars/adapters in a solid food dispenser kit that may be removably coupleable to between the mouth guard and a food pouch such that the dispenser can connect to a variety of different pouch styles. Thus the food dispenser provider can advertise that their product is usable with a great variety of food pouches produced by others. The dispenser includes a slit aperture in the dispenser nipple which may be a cross-shaped aperture, U-shaped aperture, and/or any other shape that will reform into a sealed shape when suction is not applied but will progressively open when suction is applied (i.e. that the opening will enlarge more the more suction is applied).

The dispenser includes an easy attachment/detachment device from the food pouch which may include a child protection lock/feature to prevent removal of the pouch by the child, thus reducing the risk of a mess when feeding a small child. The dispenser includes a mouth bracket on the food dispenser with a nipple which may be of any shape that prevents entry of the nipple too far into the mouth of the user, including but not limited to spherical guards, block-shaped guards, guards shaped like a profile of a licensed character, etc. It may be that the mouth bracket doesn't cup mouth. It may be that the mouth bracket is removably coupled to the nipple, such as but not limited to by a cylindrical sleeve extending from the nipple.

According to one embodiment of the invention, the solid food may be a puree. A puree is a general term for cooked food, usually vegetables or legumes, that have been ground, pressed, blended, and/or sieved to the consistency of a soft creamy paste or thick liquid. Purees of specific foods are often known by specific names, e.g., mashed potatoes or apple sauce. Purèes overlap with other dishes with similar consistency, such as thick soups, creams (crémes) and gravies—although these terms often imply more complex recipes and cooking processes. Coulis (French for "strained") is a similar but broader term, more commonly used for fruit purees. The term is not commonly used for paste-like foods prepared from cereal flours, such as gruel or muesli; nor with oily nut pastes, such as peanut butter. The term "paste" is often used for purees intended to be used as an ingredient, rather than eaten. Purees may be made in a blender, or with special implements such as a potato masher, or by forcing the food through a strainer, or simply by crushing the food in a pot. Purees generally must be cooked, either before or after grinding, in order to improve flavor and texture, remove toxic substances, and/or reduce their water content. It is common to puree entire meals (without use of salt or other additives) to be served to toddlers, babies, and those unable to chew as sufficient, nutritious meals.

In operation, there may be a user and a supervisory user (e.g. child and parent). The supervisory user may take a clean food dispenser assembly (nipple and mouth guard) and may break a seal on a food pouch that is pre-filled with a solid food (e.g. pureed carrots). The supervisory user than coupled the dispenser assembly to the food pouch such that fluid communication between the interior of the food pouch and the interior of the nipple is established, thus forming a solid food dispenser. The supervisory user may then give the solid food dispenser to the user. The user then puts the nipple in the mouth and sucks, thereby causing the nipple to open sufficient to dispense solid food into the mouth of the user. The user swallows the solid food as dispensed. This operation is in alternative to the supervisory user opening a jar of solid food and feeding the user by hand with a spoon or handing the jar and spoon to the user to feed themselves. The use of the jar and spoon is a time intensive process that is also generally very messy.

Figure 2:
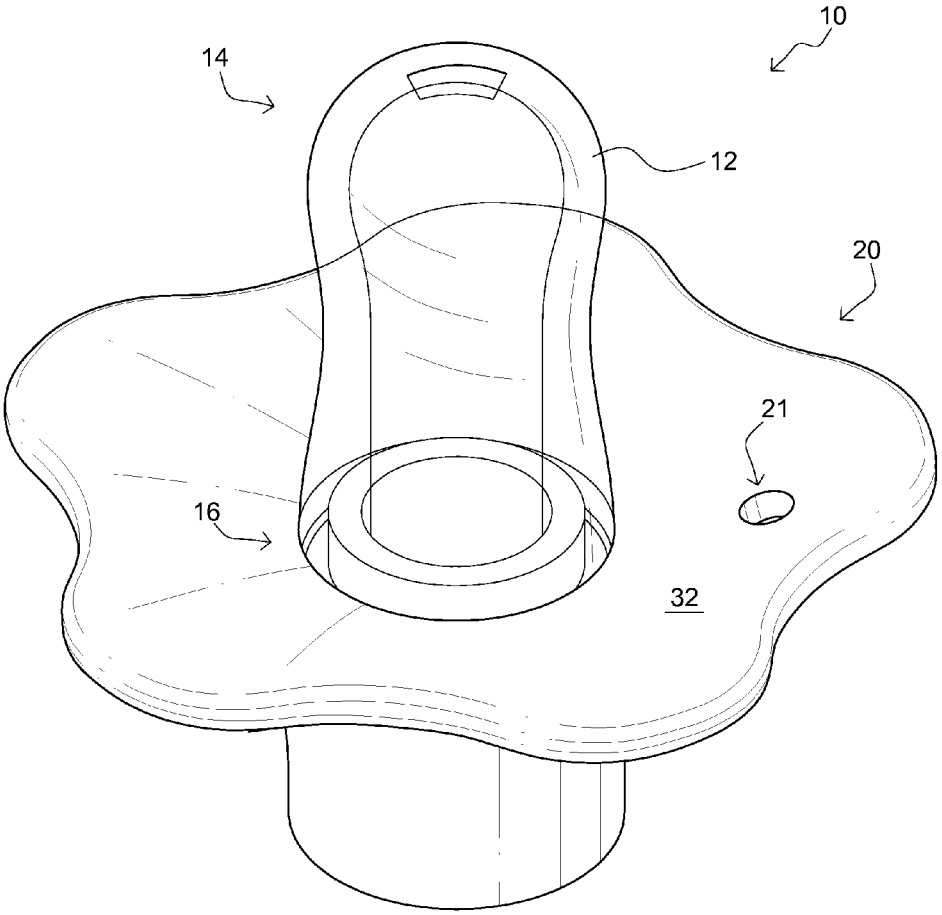
FIG. 2 is a perspective view of a nipple and a shield of a food dispenser, according to one embodiment of the invention.

FIG. 2 is a perspective view of a nipple and a shield of a food dispenser, according to one embodiment of the invention. There is shown a food dispenser 10 including a nipple 12 coupled to a shield 20.

The illustrated food dispenser 10 is configured to dispense solid food for immediate consumption. The food dispenser 10 includes a nipple 12. The nipple 12 includes a first end 14 and a second end 16, opposite the first end 14. The food dispenser 10 includes a shield 20 coupled to the nipple 12, at the second end 16 of the nipple 12. The shield 20 is a flat annular disc 32 that is not cupped. The nipple 12 and the shield 20 are co-molded together. The illustrated shield includes an aperture 21 therethrough through which air may pass to improve the safety, comfort and convenience of the article as appropriate. There may more than one such aperture in various embodiments.

The illustrated solid food dispenser 10 is designed to assist young children to eat solid food from a container. The solid food dispenser includes an attachment member for coupling to a solid food container or pouch. The attachment member is configured to selectably couple to an opening of the solid food container thereby providing a passageway for the solid food to travel through the dispenser and out a nipple. The attachment member is designed to couple to standard solid food containers or pouch openings thereby creating a seal. The attachment member may include threads to attach to the solid food container or pouch. The attachment member may include a quick connect device that easily snaps over and attaches to any opening of a food container or pouch.

Figure 3:
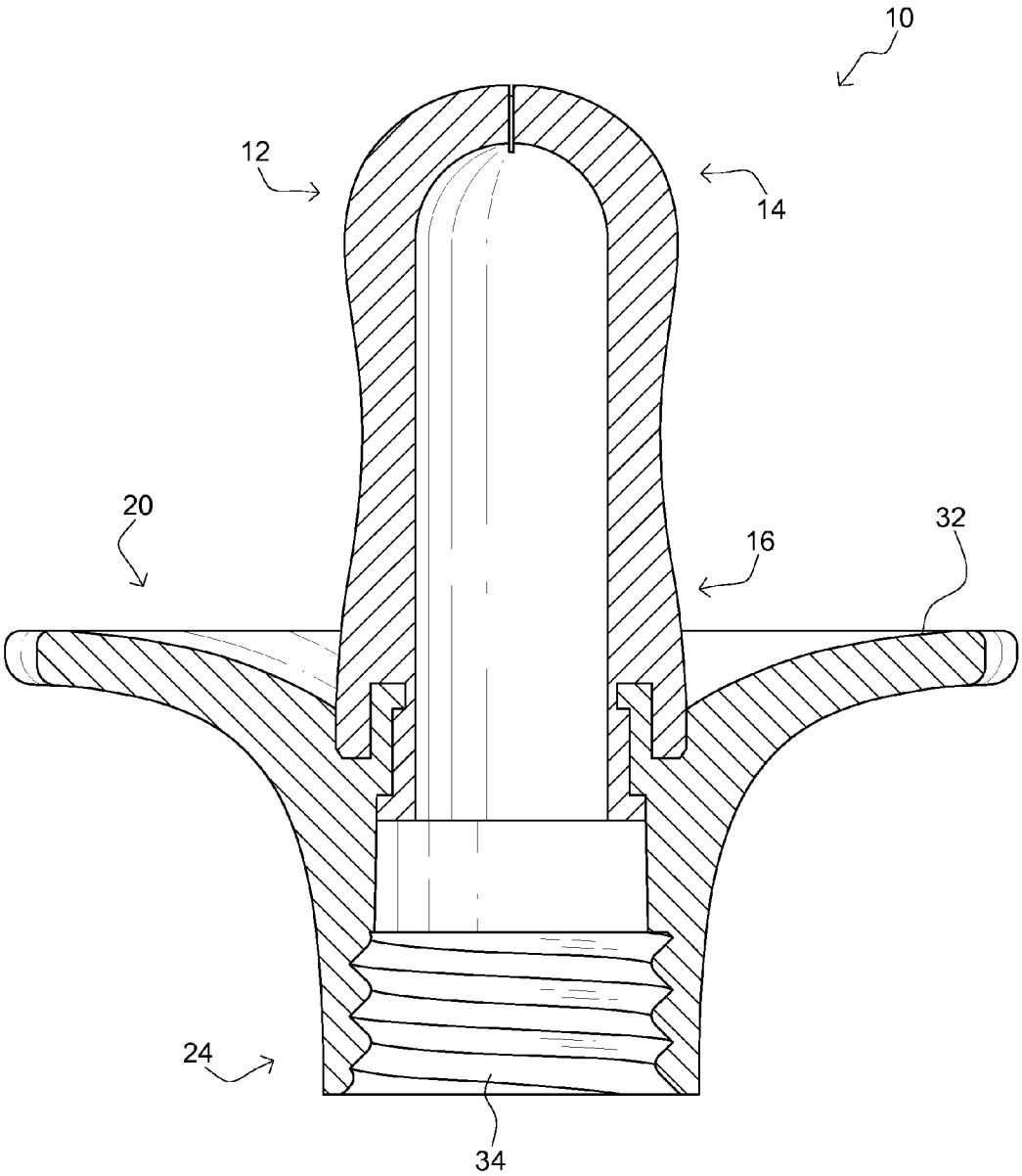
FIG. 3 is a side elevational cross-sectional view of a nipple and a shield of a food dispenser, according to one embodiment of the invention.

FIG. 3 is a side elevational cross-sectional view of a nipple and a shield of a food dispenser, according to one embodiment of the invention. There is shown a food dispenser 10 including a nipple 12, a shield 20, and a protruding attachment member 24.

The illustrated food dispenser 10 is configured to dispense solid food for immediate consumption. The food dispenser 10 includes a nipple 12. The nipple 12 includes a first end 14 and a second end 16, opposite the first end 14.

The food dispenser 10 includes a shield 20 coupled to the nipple 12, at the second end 16 of the nipple 12. The shield 20 is a flat annular disc 32 that is not cupped (note that while there is a radial curvature to the shield from the nipple outwardly to the edge of the shield, the edge of the shield is all in a single plane and the curvature is negative (the curve is bowed inwardly) and not a negative (cupping, bowed outwardly to make extra room) curvature). The shield 20 includes a protruding attachment member 24 extending opposite the nipple 12. The nipple 12 and the shield 20 are a single integral unit. The nipple 12 and the shield 20 are co-molded together.

The food dispenser 10 includes a threaded connector 34 between the shield 20 and a food pouch selectably connecting the shield 20 to a food pouch (not shown). The threaded connector 34 includes threads that correspond to matching threads disposed on an aperture of a food pouch, thereby mating the shield 20 and nipple 12 of the food dispenser 10 to a food pouch.

The illustrated solid food dispenser is designed to selectably attach to a solid food container or pouch to assist in dispensing solid food to an infant or child. The solid food dispenser includes an attachment member that selectably attaches to a solid food container or pouch. The illustrated solid food dispenser includes a nipple disposed opposite of the attachment member and configured to selectably release food therethrough.

Figure 4:
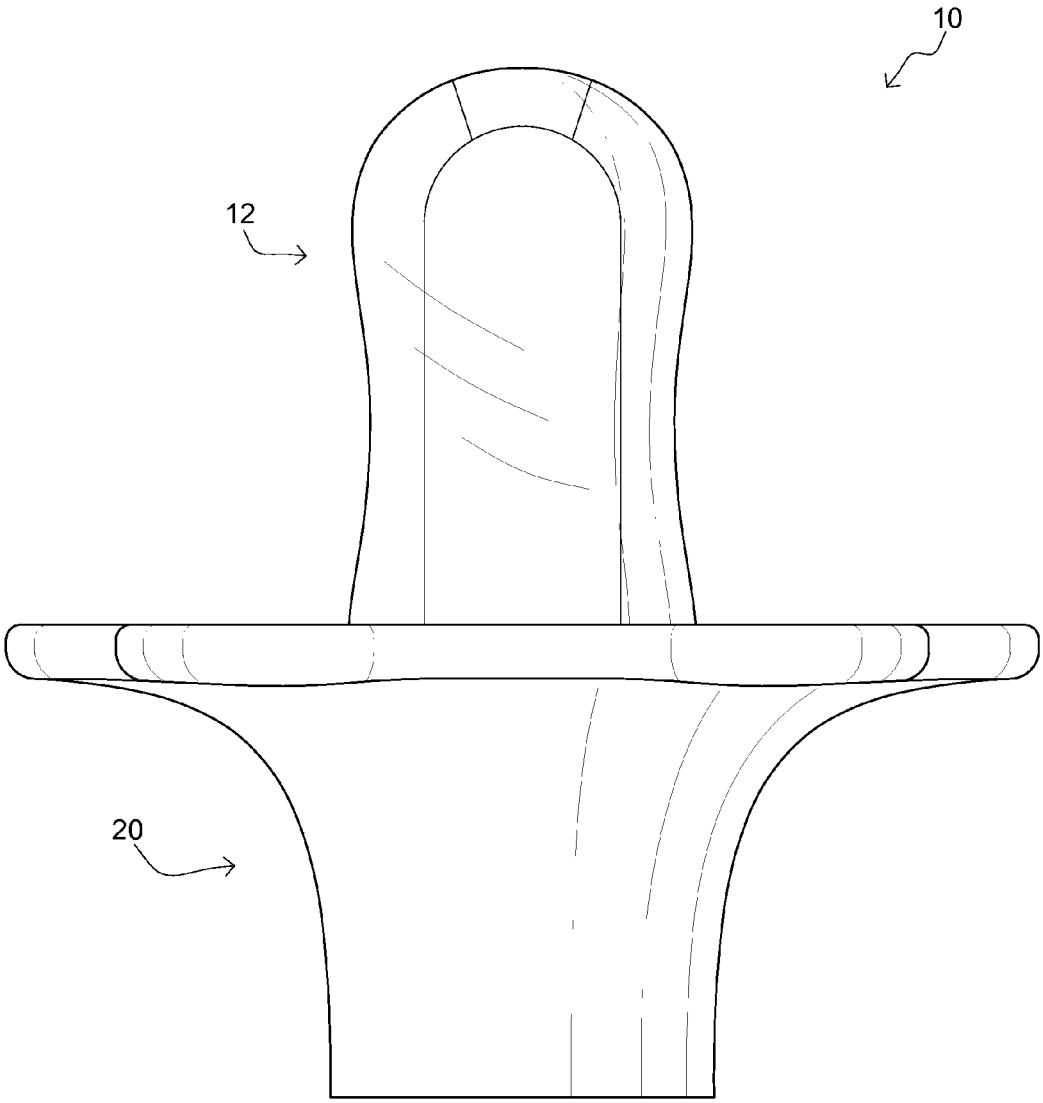
FIG. 4 is a side elevational view of a nipple and a shield of a food dispenser, according to one embodiment of the invention.

FIG. 4 is a side elevational view of a nipple and a shield of a food dispenser, according to one embodiment of the invention. There is shown a food dispenser 10 including nipple 12 and a shield 20.

The illustrated food dispenser 10 is configured to dispense solid food for immediate consumption. The food dispenser 10 includes a nipple 12. The food dispenser 10 includes a shield 20 coupled to the nipple 12. The nipple 12 and the shield 20 are a single integral unit. The nipple 12 and the shield 20 are co-molded together.

According to one embodiment of the invention, co-molding may include the process of manufacturing by shaping liquid or pliable raw material using a rigid frame called a mold or matrix wherein two different molds are used to produce a co-molded part. Such may be accomplished by the following:

The plastic frame sub-structure is produced using a typical injection mold. Once the mold's core and cavity have been manufactured, they are placed into a mold machine. A polycarbonate material is placed into a hopper, heated to the melting point and then forced under pressure into the mold. Depending on the size and configuration of the part, the cycle time can range from several seconds to several minutes. The parts are then removed from the molds and the cycle is repeated. The finished frames are then either packaged to be used at a later time or move to the next step in the process.

The next step is to mold the silicone around the plastic frame. The frame is inserted and suspended in the silicone compression mold. Typically the silicone material is placed in strips on the surface of the mold and around the frame. After closing the mold, a combination of heated and pressure forces material into the mold and covers the frame. Again, the cycle time is dependent on the size of the part. After this process is completed, the mold is opened and the part removed and inspected. Acceptable parts are moved to the next process.

A mold or mould is a hollowed-out block that is filled with a liquid or pliable material like plastic, glass, metal, or ceramic raw materials. The liquid hardens or sets inside the mold, adopting its shape. A mold is the counterpart to a cast. The very common bi-valve molding process uses two molds, one for each half of the object. Piece-molding uses a number of different molds, each creating a section of a complicated object. This is generally only used for larger and more valuable objects.

The manufacturer who makes the molds is called the mold maker A release agent is typically used to make removal of the hardened/set substance from the mold easier. Typical uses for molded plastics include molded furniture, molded household goods, molded cases, and structural materials.

Injection molding (injection molding in the USA) is a manufacturing process for producing parts by injecting material into a mould. Injection molding may be performed with a host of materials, including metals, glasses, elastomers, confections, and most commonly thermoplastic and thermosetting polymers. Material for the part is fed into a heated barrel, mixed, and forced into a mould cavity, where it cools and hardens to the configuration of the cavity. After a product is designed, usually by an industrial designer or an engineer, moulds are made by a mould maker (or toolmaker) from metal, usually either steel or aluminum, and precision-machined to form the features of the desired part. Injection molding is widely used for manufacturing a variety of parts, from the smallest components to entire body panels of cars. Advances in 3D printing technology, using photopolymers which do not melt during the injection molding of some lower temperature thermoplastics, can be used for some simple injection moulds.

Parts to be injection molded are generally very carefully designed to facilitate the molding process; the material used for the part, the desired shape and features of the part, the material of the mould, and the properties of the molding machine must all be taken into account. The versatility of injection molding is facilitated by this breadth of design considerations and possibilities.

Injection molding of liquid silicone rubber (LSR) is a process to produce pliable, durable parts in high volume. Liquid silicone rubber is a high purity platinum cured silicone with low compression set, great stability and ability to resist extreme temperatures of heat and cold ideally suitable for production of parts, where high quality is a must. Due to the thermosetting nature of the material, liquid silicone injection molding requires special treatment, such as intensive distributive mixing, while maintaining the material at a low temperature before it is pushed into the heated cavity and vulcanized.

Chemically, silicone rubber is a family of thermoset elastomers that have a backbone of alternating silicon and oxygen atoms and methyl or vinyl side groups. Silicone rubbers constitute about 30% of the silicone family, making them the largest group of that family. Silicone rubbers maintain their mechanical properties over a wide range of temperatures and the presence of methyl-groups in silicone rubbers makes these materials extremely hydrophobic.

Typical applications for liquid silicone rubber are products that require high precision such as seals, sealing membranes, electric connectors, multi-pin connectors, infant products where smooth surfaces are desired, such as bottle nipples, medical applications as well as kitchen goods such as baking pans, spatulas, etc. Often, silicone rubber is overmolded onto other parts made of different plastics. For example, a silicone button face might be overmolded onto an Nylon 6,6 housing.

The illustrated solid food dispenser is designed to selectably attach to a solid food container or pouch to assist in dispensing solid food to an infant or child. The solid food dispenser includes an attachment member that selectably attaches to a solid food container or pouch. The illustrated solid food dispenser includes a receiving member coupled to the attachment member and configured to couple the attachment member to a nipple. The receiving member is configured to provide a passage way from the solid food container or pouch through the attachment member and the receiving member and out to the nipple and out therefrom. The illustrated receiving member includes threads to selectably couple to the attachment member opposite of the solid food container or pouch. The attachment member also includes threads, matching the threads of the receiving member and configured to couple thereto.

Figure 5:
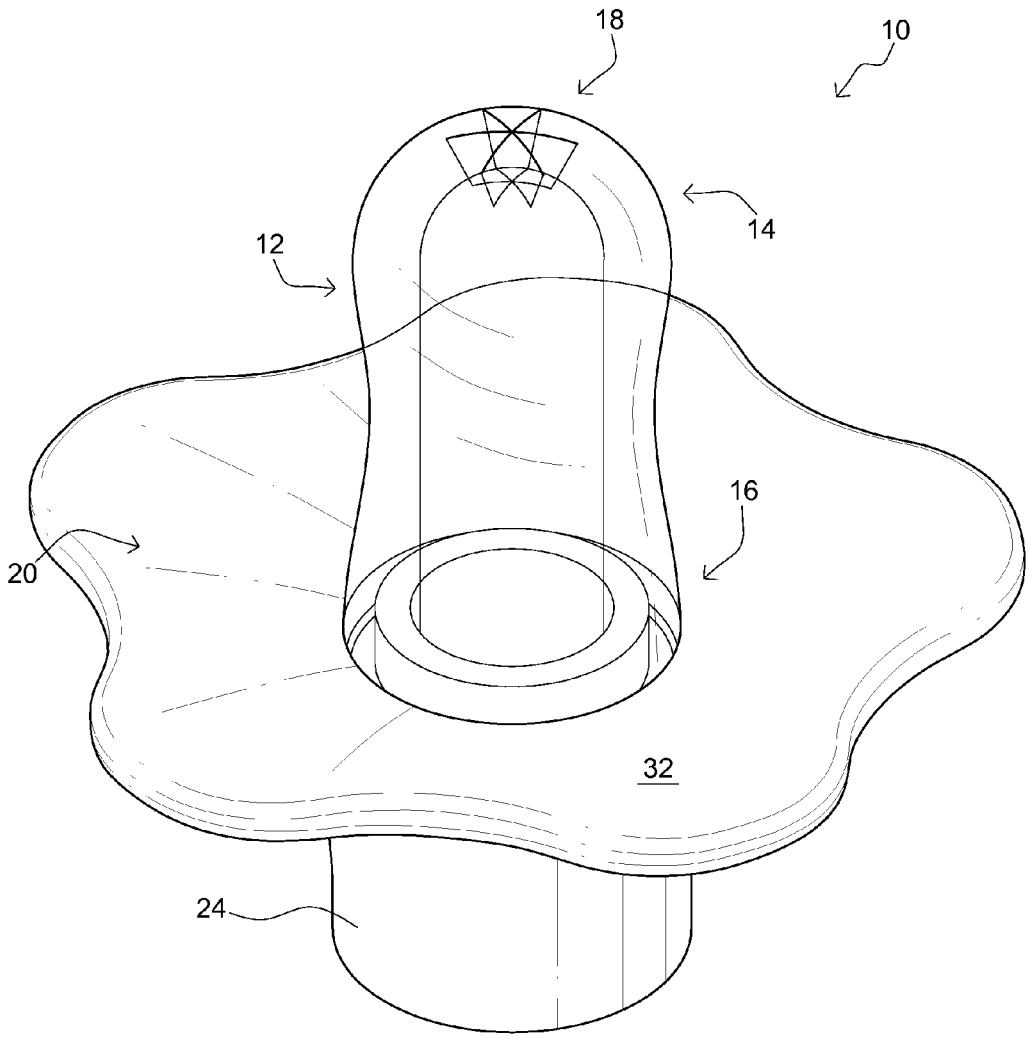
FIG. 5 is a perspective view of a nipple and a shield of a food dispenser, according to one embodiment of the invention.

FIG. 5 is a perspective view of a nipple and a shield of a food dispenser, according to one embodiment of the invention. There is shown a food dispenser 10 including a shield 20 and a nipple 12 having a bite valve 18 with a star-shaped multi-slit configuration (three slits that cross and share the same crossing point) as opposed to the single slit configuration of FIG. 2.

The illustrated food dispenser 10 is configured to dispense solid food for immediate consumption. The food dispenser 10 includes a nipple 12. The nipple 12 includes a first end 14 and a second end 16, opposite the first end 14. The nipple 12 includes a bite valve 18 disposed on the first end 14. The bite valve 18 is a valve in communication with the contents of a food pouch, wherein the bite valve 18 enables the start and stop of consumption of solid food from a food pouch with minimal effort.

The food dispenser 10 includes a shield 20 coupled to the nipple 12, at the second end 16 of the nipple 12. The shield 20 is a flat annular disc 32 that is not cupped. The shield 20 includes a protruding attachment member 24 extending opposite the nipple 12.

The illustrated solid food dispenser is designed to selectably attach to a solid food container or pouch to assist in dispensing solid food to an infant or child. The solid food dispenser includes an attachment member that selectably attaches to a solid food container or pouch. The illustrated solid food dispenser includes a receiving member coupled to the attachment member and configured to couple the attachment member to a nipple. The receiving member is configured to provide a passage way from the solid food container or pouch through the attachment member and the receiving member and out to the nipple and out therefrom. The illustrated receiving member also includes a mouth guard to prevent the nipple from inserting too far into the mouth. The mouth guard may vary in size and shape and still perform its intended function.

Figure 6:
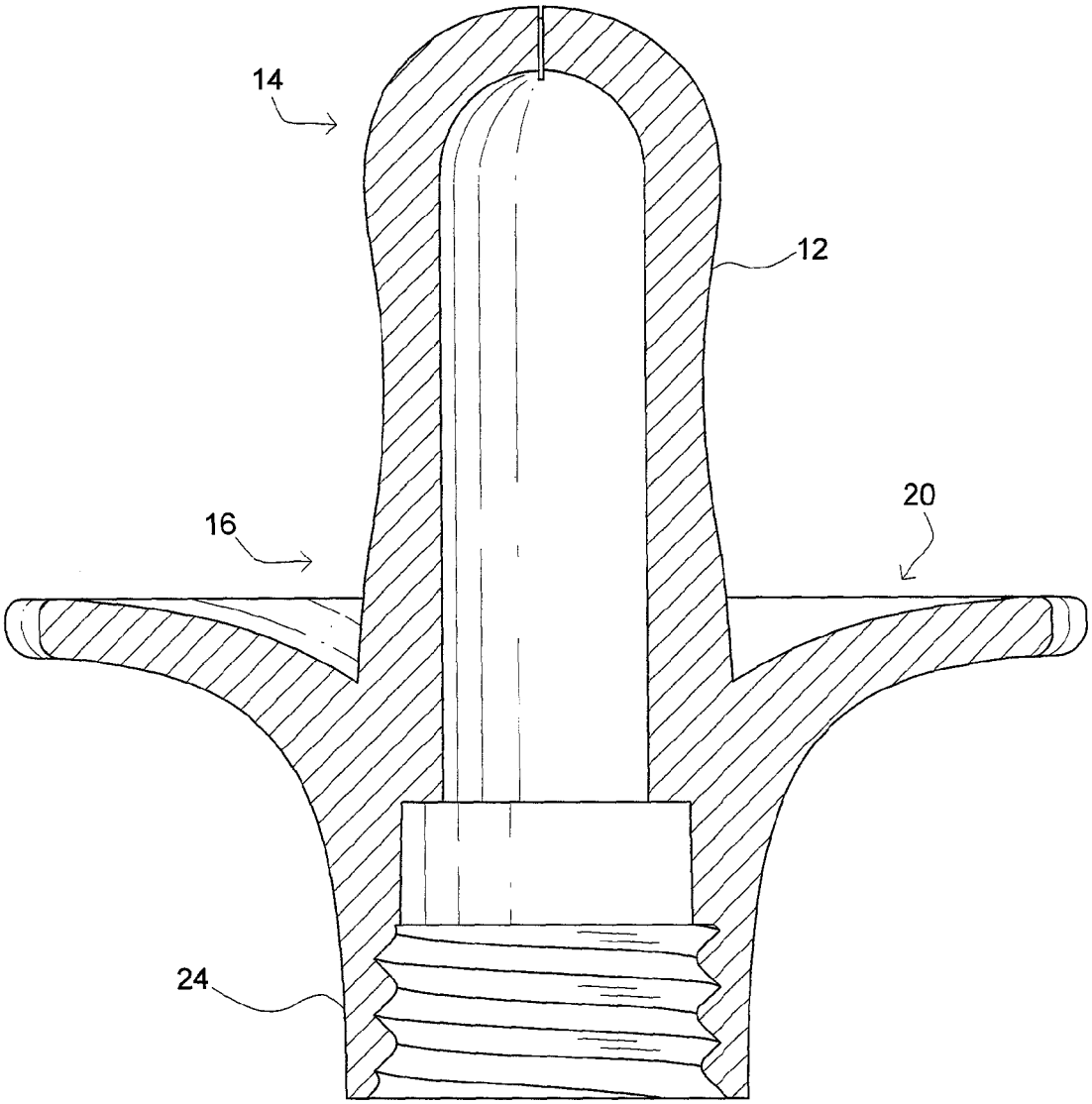
FIG. 6 is a side elevational cross-sectional view of a nipple and a shield of a food dispenser, according to one embodiment of the invention.

FIG. 6 is a side elevational view of a nipple and a shield of a food dispenser, according to one embodiment of the invention. There is shown a food dispenser 10 including a nipple 12, a shield 20, and a protruding attachment member 24. The illustrated nipple and shield are a single molded part (note that there is not an abrupt transition of material from nipple to shield).

The illustrated food dispenser 10 is configured to dispense solid food for immediate consumption. The food dispenser 10 includes a nipple 12. The nipple 12 includes a first end 14 and a second end 16, opposite the first end 14.

The food dispenser 10 includes a shield 20 coupled to the nipple 12, at the second end 16 of the nipple 12. The shield 20 includes a protruding attachment member 24 extending opposite the nipple 12. The nipple 12 and the shield 20 are a single integral unit. The nipple 12 and the shield 20 are molded or otherwise formed (e.g. 3D printing) as a single unit. The food dispenser 10 includes a threaded connector between the shield 20 and a food pouch selectably connecting the shield 20 to the food pouch.

The illustrated solid food dispenser is designed to selectably attach to a solid food container or pouch to assist in dispensing solid food to an infant or child. The solid food dispenser includes an attachment member that selectably attaches to a solid food container or pouch. The illustrated solid food dispenser includes a receiving member coupled to the attachment member and configured to couple the attachment member to a nipple. The receiving member is configured to provide a passage way from the solid food container or pouch through the attachment member and the receiving member and out to the nipple and out therefrom. The illustrated solid food dispenser may include a decorative member configured to dispose over the attachment member, thereby providing a decorative element or identifier for the solid food dispenser.

Figure 7:
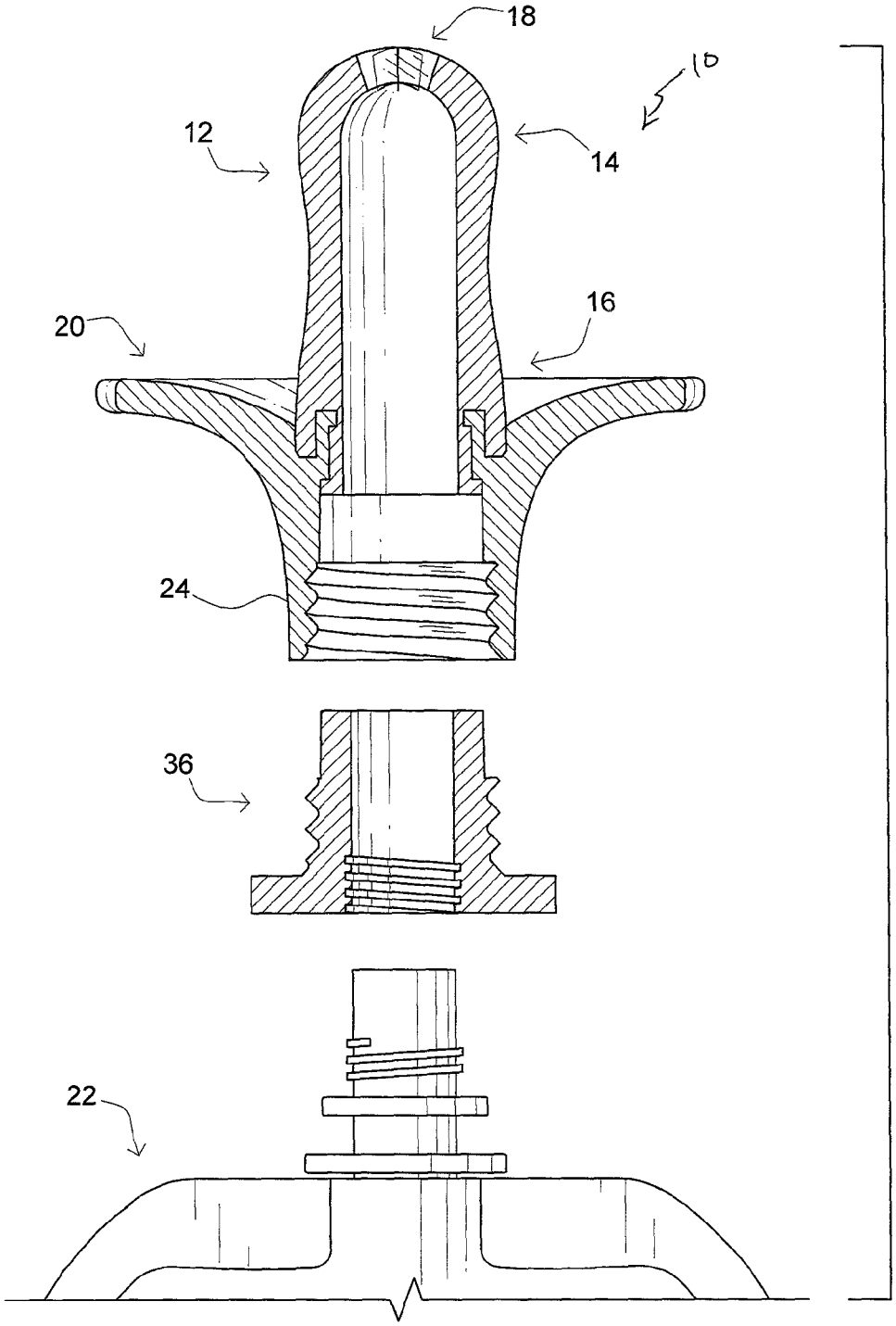
FIG. 7 is a side elevational cross-sectional view of a nipple and a shield and an adapter of a food dispenser, according to one embodiment of the invention.

FIG. 7 is a side elevational view of a nipple and a shield and an adapter of a food dispenser, according to one embodiment of the invention. There is shown a food dispenser 10 including a nipple 12, a shield 20, a protruding attachment member 24 and an adapter 36.

The illustrated food dispenser 10 is configured to dispense solid food for immediate consumption. The food dispenser 10 includes a nipple 12. The nipple 12 includes a first end 14 and a second end 16, opposite the first end 14. The nipple 12 includes a bite valve 18 disposed on the first end 14.

The food dispenser 10 includes a shield 20 coupled to the nipple 12, at the second end 16 of the nipple 12. The shield 20 includes a protruding attachment member 24 extending opposite the nipple 12.

The food dispenser 10 includes an adapter 36 coupled between the shield 20 and the food pouch 22 mating incompatible attachment structures of each.

Figure 8:
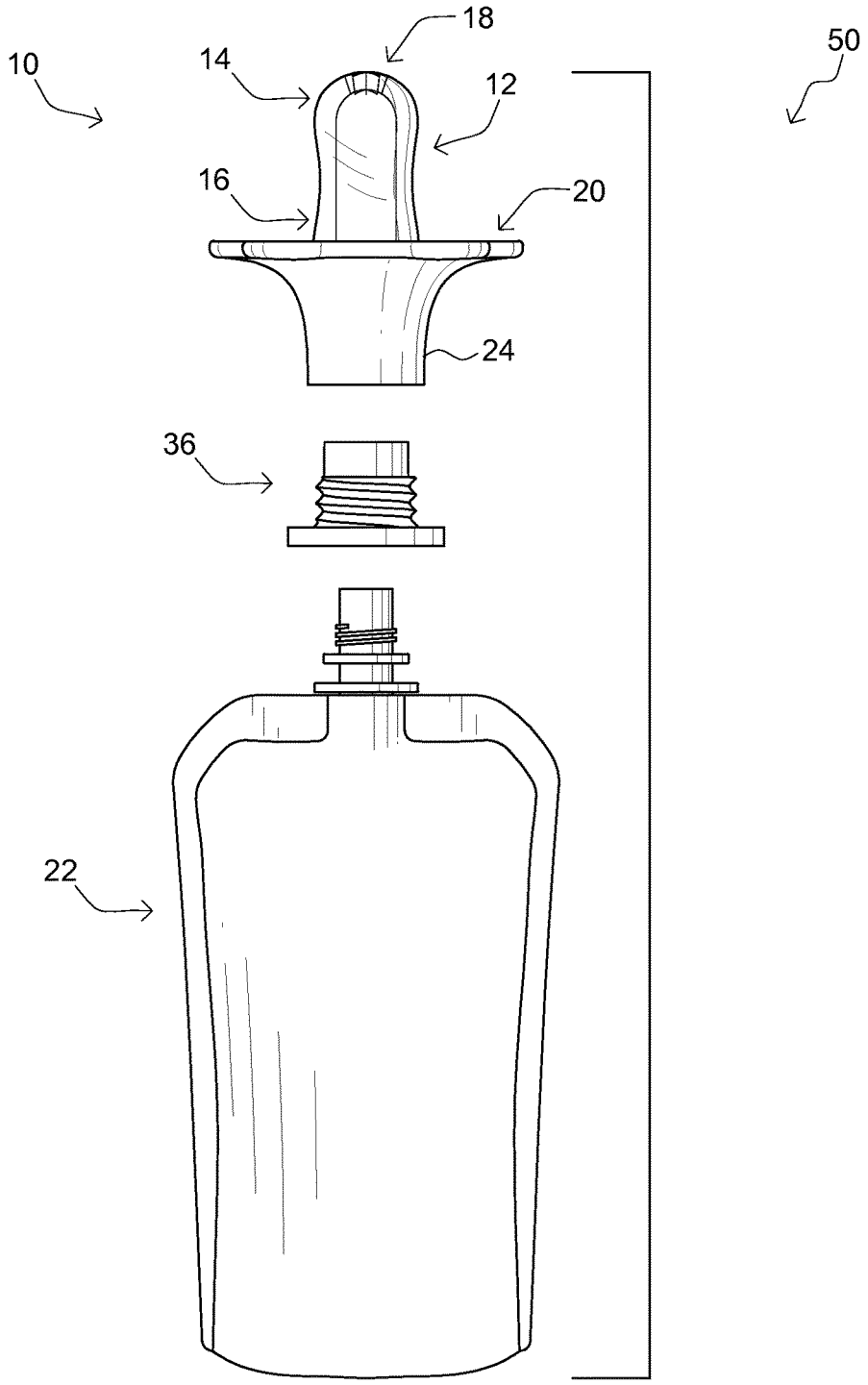
FIG. 8 is a side elevational view of a food dispensing kit, according to one embodiment of the invention.

FIG. 8 is a perspective view of a food dispensing kit, according to one embodiment of the invention. There is shown a food dispensing kit 50 including a food dispenser 10 having a nipple 12 and a shield 20 coupleable to a food pouch 22 by an adaptor 36. There may be multiple nipple/shield components in a kit that may include progressively larger slits/valves that allow for progressively larger chunks to pass therethrough to help a baby transition gradually to larger and larger sized chunks of solid food. There may be a plurality of adapters having differently shaped/sized coupling structures that may allow for coupling between variously shaped/sized nipple/shield units and differently shaped/sized food pouches. There may be a plurality of food pouches that include food having progressively larger chunks of solid food therein to allow for a baby to gradually progress to eating larger and larger chunks of solid food. Such pouches may be labeled using a system to let caregivers know what size the largest chunks of solid food will be in a particular pouch. It is envisioned that there may be other characteristics of such transitional solid food that may be relevant to the progression and/or development of a baby, such as but not limited to consistency, starchiness, and the like that may be also presented in a set of progressively variant food pouches that are labeled accordingly.

The illustrated food dispensing kit 50 is configured to dispense solid food for immediate consumption. The illustrated food dispenser kit 50 includes a food dispenser 10 configured to dispense solid food for immediate consumption. The food dispenser 10 includes a nipple 12. The nipple 12 includes a first end 14 and a second end 16, opposite the first end 14. The nipple 12 includes a bite valve 18 disposed on the first end 14.

The food dispenser 10 includes a shield 20 coupled to the nipple 12, at the second end 16 of the nipple 12. The shield 20 includes a protruding attachment member 24 extending opposite the nipple 12. The nipple 12 and the shield 20 are a single integral unit. The illustrated nipple 12 and the shield 20 are co-molded together.

The food dispenser 10 includes a food pouch 22 having flexible side-walls coupled to the shield 20 and in fluid communication with the bite valve 18. The food pouch 22 contains solid food.

The food dispenser 10 includes an adapter 36 coupled between the shield 20 and the food pouch 22 mating incompatible attachment structures of each.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the illustrated apertures have either one or three slits, it is understood that such valves may have numerous slit configurations that still function to allow for closure when not in use and allow for the passage of larger bodies of solid food during use.

Additionally, although the figures illustrate pouches that are formed by sealed edges of planar materials it is understood that pouches may be more simply formed (e.g. singular bodies with cavities therein) or may be more complex (e.g. multi-sided flexible box structures).

It is also envisioned that the pouches may be refillable.

It is expected that there could be numerous variations of the design of this invention. An example is that the nipple, shield, and/or pouch may be decorated, ornamented, or otherwise include aesthetically pleasing images, shapes, bodies, forms, and the like and/or may be branded with characters attractive to babies that are transitioning to solid food. As a non-limiting example, a food pouch may be in the profile shape of a beloved cartoon character.

Finally, it is envisioned that the components of the device may be constructed of a variety of materials, such as but not limited to plastics, rubbers, silicone, metals, ceramics, woven fibers, natural materials, composites and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A food dispenser, configured to dispense solid food for immediate consumption, comprising:

a) a nipple including a first end and a second end, opposite the first end, with a bite valve disposed on the first end;

b) a shield coupled to the nipple, at the second end of the nipple; and c) a food pouch having flexible side-walls coupled to the shield and in fluid communication with the bite valve; wherein the food pouch contains solid food.

2. The dispenser of claim 1, further comprising a threaded connector between the shield and the food pouch selectably connecting the shield to the food pouch.

3. The dispenser of claim 1, wherein the nipple and the shield are a single integral unit.

4. The dispenser of claim 3, wherein the nipple and the shield are co-molded together.

5. The dispenser of claim 1, wherein the shield is a flat annular disc that is not cupped.

6. The dispenser of claim 1, further comprising adapter coupled between the shield and the food pouch that mates incompatible attachment structures of each.

7. The dispenser of claim 1, wherein the shield includes a protruding attachment member extending opposite the nipple.

8. A food dispenser, configured to dispense solid food for immediate consumption, comprising:

a) nipple including a first end and a second end, opposite the first end, with a bite valve disposed on the first end; and a1) the bite valve having a single slit disposed thereon;

b) a shield coupled to the nipple, at the second end of the nipple; wherein the shield includes a protruding attachment member extending opposite the nipple.

9. The dispenser of claim 8, further comprising a threaded connector between the shield and a food pouch selectably connecting the shield to a food pouch.

10. The dispenser of claim 9, wherein the nipple and the shield are a single integral unit.

11. The dispenser of claim 10, wherein the nipple and the shield are co-molded together.

12. The dispenser of claim 11, wherein the shield is a flat annular disc that is not cupped.

13. The dispenser of claim 8, further comprising an adapter coupled between the shield and a food pouch that mates incompatible attachment structures of each.

14. A food dispensing kit, configured to dispense solid food for immediate consumption, comprising:

a) a nipple including a first end and a second end, opposite the first end, with a bite valve disposed on the first end;

b) a shield coupled to the nipple, at the second end of the nipple; and c) a food pouch having flexible side-walls in fluid communication with the bite valve; wherein the food pouch contains solid food.

15. The kit of claim 14, further comprising a threaded connector between the shield and the food pouch selectably connecting the shield to the food pouch.

16. The kit of claim 15, wherein the nipple and the shield are a single integral unit.

17. The kit of claim 16, wherein the nipple and the shield are co-molded together.

18. The kit of claim 17, wherein the shield is a flat annular disc that is not cupped.

19. The kit of claim 14, further comprising an adapter coupled between the shield and the food pouch that mates incompatible attachment structures of each.

20. The kit of claim 19, wherein the shield includes a protruding attachment member extending opposite the nipple.

* * * * *